United States Patent [19]

Heard et al.

[11] 4,236,318

[45] Dec. 2, 1980

[54] METHODS AND APPARATUS FOR HEATING PARTICULATE MATERIAL

[75] Inventors: Harold Heard; Charles R. Wilt, Jr., both of Pittsburgh, Pa.

[73] Assignee: Salem Corporation, Pittsburgh, Pa.

[21] Appl. No.: 20,168

[22] Filed: Mar. 13, 1979

[51] Int. Cl.[3] ..... F26B 3/08; F26B 3/10

[52] U.S. Cl. ..... 34/10; 34/57 R; 34/72

[58] Field of Search ..... 34/10, 12, 57 R, 57 A, 34/72, 73, 75

[56] References Cited

U.S. PATENT DOCUMENTS

| | | | |
|---|---|---|---|
| 2,132,656 | 10/1938 | Smith | 34/57 R |
| 2,666,269 | 1/1954 | Parry | 34/10 |
| 3,212,197 | 10/1965 | Crawford | 34/10 |
| 3,773,892 | 11/1973 | Reimann et al. | 34/57 R |
| 3,800,427 | 4/1974 | Kemmetmueller | 34/10 |
| 3,985,517 | 10/1976 | Johnson | 34/10 |
| 4,043,049 | 8/1977 | Hedstrom | 34/10 |
| 4,153,427 | 5/1979 | Bissett et al. | 34/10 |

*Primary Examiner*—John J. Camby

*Attorney, Agent, or Firm*—Buell, Blenko, Ziesenheim & Beck

[57] ABSTRACT

A method and apparatus are provided for heating and/or drying particulate materials such as coal wherein the particulates are fed into a fluidizing chamber, carried in a stream of heated oxygen-free gas at a temperature sufficiently high to heat the particles to a preselected temperature. The particles are then removed from the gas stream at the preselected temperature and then the gas is reheated in a heat exchanger and recycled. Where the particulate material to be dried yields a vapor, such as steam, the vapor is used as the transport or fluidizing gas. Means are provided for removing and/or condensing such vapor beyond the amount needed for fluidization.

8 Claims, 2 Drawing Figures

METHODS AND APPARATUS FOR HEATING PARTICULATE MATERIAL

Figure 1:
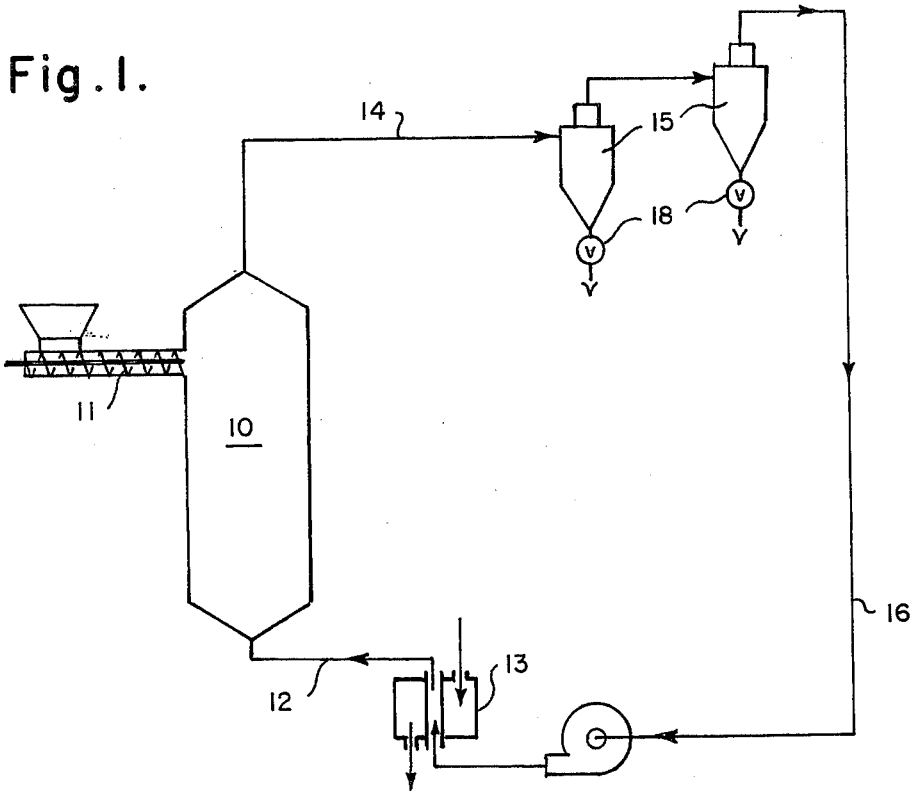

This invention relates to methods and apparatus for heating particulate material and particularly to a method and apparatus for heating and drying finely divided coal and similar particulate materials prior to subsequent use or further processing.

In the processing of many materials there is frequently a stage where it is necessary or desirable to preheat the material in finely divided particulate form. This is true of many polymers, mineral solids and organic solids such as coal. Coal is a particularly good example of such materials and is particularly pertinent at the present time because of the need to conserve liquid and gaseous hydrocarbons and to substitute in their stead coal as a source of energy. Coal, particularly when very finely divided, must be carefully handled because of the danger of explosions which occur in the presence of free oxygen in the coal heating and/or drying atmosphere. This is equally true of other finely divided oxidizable materials such as plastics, etc.

There have been various proposals made for drying coal and other fine particulate materials. Typical of prior art patents dealing with this subject are:

| | | |
|---|---|---|
| U.S. Pat. No. 2,833,055 | Wright | May 6, 1958 |
| U.S. Pat. No. 2,956,347 | Gordon | October 18, 1960 |
| U.S. Pat. No. 3,190,867 | Oldweiler | June 22, 1965 |
| U.S. Pat. No. 3,192,068 | Brandt | June 29, 1965 |
| U.S. Pat. No. 3,212,197 | Crawford | October 19, 1965 |
| U.S. Pat. No. 3,218,729 | Micklich | November 23, 1965 |
| U.S. Pat. No. 3,238,634 | Goins | March 8, 1966 |
| U.S. Pat. No. 3,250,016 | Aqarwal | May 10, 1966 |
| U.S. Pat. No. 3,309,780 | Goins | March 21, 1967 |
| U.S. Pat. No. 3,339,286 | Stephanoff | September 5, 1967 |
| U.S. Pat. No. 3,699,662 | Stephanoff | October 24, 1972 |
| U.S. Pat. No. 3,800,427 | Kemmetmueller | April 2, 1974 |
| U.S. Pat. No. 3,805,401 | Fontein | April 23, 1974 |
| U.S. Pat. No. 3,823,487 | Cherry | July 16, 1974 |
| U.S. Pat. No. 3,879,856 | Barr | April 29, 1975 |
| U.S. Pat. No. 3,884,620 | Rammler | May 20, 1975 |
| U.S. Pat. No. 3,896,557 | Seitzer | July 29, 1975 |
| U.S. Pat. No. 3,921,307 | Marek | November 25, 1975 |

These patents show various drying processes for pulverulent or granular material in which the pulverulent or granular material is fluidized in a flowing stream of gas which may include or may be in entirety the vaporized liquid contaminant itself. The patents in which this is disclosed are basically patents for the treatment of polymer materials and coal in which an organic liquid contaminant or water is being removed. The patents are in general much more complex and expensive in structure and operation than is the present invention and have generally not been adopted to any extent in the trade, to our knowledge.

Of the foregoing patents the Kemmetmueller, U.S. Pat. No. 3,800,427 and Crawford U.S. Pat. No. 3,212,197 are perhaps the most pertinent. Kemmetmueller is, however, essentially tied to sulfur removal of coking coal and requires the simultaneous introduction of inert gas and steam to dry the coal and remove sulfur. It is a relatively complex operation and is not satisfactory for general heating or drying of particulate materials. In Kemmetmueller substantial amounts of sulfur containing gases are evolved and must be treated and there is no recycling of the transport fluid. Crawford is similarly quite complex and involves the use of a scrubber to scrub the transport gas to remove extraneous vapors and to control the system pressure. Such a system is structurally complex and expensive to operate and produces a large volume of scrubber waste which must be purified or it becomes an environmental pollutant.

We have invented a method of drying and/or heating particulate materials which depends upon using a recirculating condensible fluid such as steam to provide a fluidized bed of particulates being heated and a recovery means for removing particulates which have been heated and/or dried to a preselected level.

Where a condensible gas or vapor is released in the heating and/or drying step, the vapor becomes the transport media and means are provided for maintaining the temperature of such gas or vapor and for removing that portion which is in excess of that needed to carry the particulates in the fluidized bed. Thus, in this application, when we speak of an inert or "oxygen free" gas we mean a gas which is free of oxygen in quantities that will have a deleterious effect on the product.

Preferably we provide a method which comprises the steps of delivering a particulate material to be heated and/or dried to a fluidizing chamber, fluidizing and heating said particulate material with an upwardly flowing stream of heated gas at a temperature sufficient to raise the temperature of the particulate material to a preselected level and at a flow rate sufficient to fluidize and/or transport the particulate material, removing said heated particulate material from the fluidized bed, reheating the gas in a heat exchanger and recycling the same into the fluidized bed whereby the fluidizing gas is continuously recirculated. Preferably, if the particulate material is wet and generates gas vapors during heating, e.g. steam, in the case of water washed coal particulates, the vapors are used as the inert transport gas for the fluidized bed and means are provided for removing and condensing the excess vapors. Where the particulate material fed to the system is completely dry, a suitable vapor may be added to make up any lost from the system with the heated removed particulates.

In the case of coal this practice is highly environmentally protective because only heated coal and water are removed. If the water is "dirty" it is much easier to handle and clean than is dirty gas.

Figure 2:
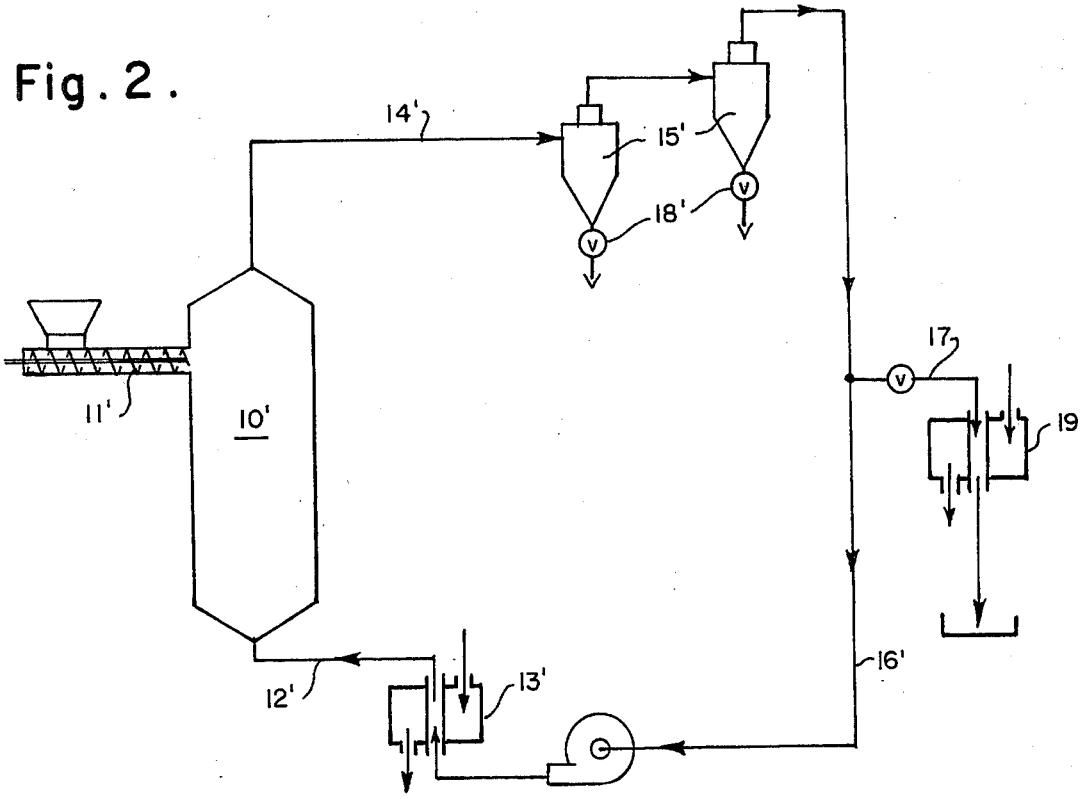

In the foregoing general description of our invention we have set out certain objects and advantages; however, other objects, purposes and advantages will be apparent from a consideration of the following description and the accompanying drawings in which:

FIG. 1 is a schematic flow sheet of our process for heating particulates; and FIG. 2 is a schematic flow sheet of our process for heating and drying particulates and removal of condensed removed vapor.

Referring to the drawings we have illustrated a fluidizing and heating chamber 10, a particulate feeder 11 delivering particulate material to be heated into said heating chamber 10 intermediate its top and bottom, a gas inlet line 12 at the bottom of chamber 10 from heat exchanger 13. An outlet line 14 at the top of chamber 10 delivers heated fluidized particulate material to one or more cyclones 15 which remove the particulate material from the transport gas which gas passes through line 16 back to heat exchanger 13 for recycling. Heated particulate material is removed from the bottom of cyclones 15 by hopper valve 18.

In the embodiment illustrated in FIG. 2 we have illustrated essentially the same arrangement but designed for drying as well as heating a particulate material. In this embodiment those elements which are the same as elements in FIG. 1 will bear like numbers with the prime suffix and the operation will be described in connection with drying of fine particle coal as representative of such materials. The coal fines are delivered to fluidizing and heating chamber 10' by feeder 11' where they are fluidized by high temperature steam from heat exchanger 13' entering chamber 10' through line 12'. The wet coal particles are fluidized and heated and the water is vaporized and joins the transport stream.

The heated and dried fluidized coal particles are carried to cyclones 15' which remove them from the gas stream which is returned by way of line 16' to heat exchanger 13'. A bleeder line 17 between cyclones 15' and heat exchanger 13' removes a portion of the gas from the system generally equal to that produced by the drying and heating of the coal and delivers it to condenser 19 where it is condensed to liquid 20 and passed out of the system to discharge or to a cleaner if necessary. The non-condensible gases are collected and passed similarly.

The structure and process of this invention has numerous advantages. It is simple yet highly efficient. It eliminates the danger of explosion common to finely divided organic particulate material. It is environmentally desirable since it eliminates all gaseous wastes which are difficult to clean. Non-condensible gases produced in the heating or drying are not contaminated with products of combustion as in a direct fired dryer or heater and means may be provided for separating condensible from non-condensible gases. This may include a condenser or similar apparatus for removing the condensible gases from the non-condensible gases. It is extremely economical in energy consumption.

In the foregoing specification we have set out certain preferred embodiments and practices of our invention; however, it will be understood that this invention may be otherwise embodied within the scope of the following claims.

We claim:

1. The method of heating and drying a solid particulate material comprising the steps of:

(a) delivering a solid particulate material to be heated to a fluidizing or heating chamber;

(b) fluidizing and heating said solid particulate material with an upwardly flowing stream of oxygen-free gas at a temperature sufficient to raise the temperature of the particulate material to a preselected level and at a flow rate sufficient to fluidize and/or transport the particulate material;

(c) removing said heated particulate material from the fluidized bed or transport stream;

(d) reheating the oxygen-free gas in a heat exchanger; and (e) recycling said oxygen-free gas into said fluidizing chamber whereby solid particulate material is continuously fluidized, heated and transported out of said fluidized bed.

2. The method as claimed in claim 1 wherein the product is heated and dried and the excess gas is removed from the system and condensed.

3. The method as claimed in claims 1 or 2 wherein the particulate material is coal and the inert gas is steam.

4. The method as claimed in claims 1 or 2 wherein the heated particulate material is removed in a cyclone separator or drained from the bed.

5. The method as claimed in claims 1 or 2 wherein the heated particulate material is removed in a plurality of cyclone separators in series.

6. Apparatus for heating solid particulate material comprising a generally vertically extending fluidizing chamber having top and bottom ends, particulate material feed means delivering particulate material into said fluidizing chamber intermediate its ends, means for introducing a heated oxygen-free gas into said fluidizing chamber adjacent its bottom end at a temperature sufficient to raise the solid particulate material to a preselected temperature and at a flow rate sufficient to fluidize and/or transport said solid particulate material, cyclone separator means connected adjacent to top end of said fluidizing chamber receiving fluidized heated particulate material and separating the same from said gas, heat exchanger means receiving the gas from said cyclone separator, means for reheating the same and means connecting said heat exchanger means to the means for delivering gas to the fluidizing chamber.

7. An apparatus as claimed in claim 6 for heating and drying having bleeder means between the cyclone means and heat exchanger removing excess gas from the system.

8. An apparatus as claimed in claim 7 including condenser means connected with the bleeder means for condensing any condensible gas to a liquid.

* * * * *